US006109240A

United States Patent [19]

Sato et al.

[11] Patent Number: 6,109,240

[45] Date of Patent: *Aug. 29, 2000

[54] APPARATUS FOR CONTROLLING A THROTTLE VALVE ELECTRONICALLY IN AN INTERNAL COMBUSTION ENGINE

[75] Inventors: Hisaaki Sato; Ikuo Mogi, both of Gunma; Masato Kumagai, Saitama; Munehiro Kudo; Keiichi Kai, both of Gunma, all of Japan

[73] Assignee: Unisia Jecs Corporation, Atsugi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/044,095

[22] Filed: Mar. 19, 1998

[30] Foreign Application Priority Data

Mar. 19, 1997 [JP] Japan ..... 9-065856

[51] Int. Cl.[7] ..... F02D 1/00

[52] U.S. Cl. ..... 123/399; 123/366

[58] Field of Search ..... 123/399, 361

[56] References Cited

U.S. PATENT DOCUMENTS

| | | | |
|---|---|---|---|
| 4,809,659 | 3/1989 | Tamaki et al. | 123/399 |
| 4,850,322 | 7/1989 | Uthoff et al. | 123/399 |
| 4,938,327 | 7/1990 | Tominaga | 192/0.02 |
| 4,951,772 | 8/1990 | Peter et al. | 180/197 |
| 4,961,255 | 10/1990 | Irino et al. | 74/513 |
| 5,016,586 | 5/1991 | Imamura et al. | 123/336 |
| 5,350,034 | 9/1994 | Sato | 180/197 |
| 5,423,299 | 6/1995 | Kumagai | 123/399 |
| 5,431,141 | 7/1995 | Kanazawa et al. | 123/399 |
| 5,467,751 | 11/1995 | Kumagai | 123/399 |
| 5,490,487 | 2/1996 | Kato et al. | 123/339 |
| 5,517,966 | 5/1996 | Kanazawa et al. | 123/399 |
| 5,829,409 | 11/1998 | Saito et al. | 123/399 |
| 5,868,114 | 2/1999 | Kamimura et al. | 123/399 |

FOREIGN PATENT DOCUMENTS

| | | |
|---|---|---|
| 0 723 072 | 7/1996 | European Pat. Off. . |
| 6-63460 | 8/1994 | Japan . |
| 2 241 740 | 9/1991 | United Kingdom . |

*Primary Examiner*—John Kwon
*Attorney, Agent, or Firm*—Foley & Lardner

[57] ABSTRACT

An apparatus for controlling a throttle valve electronically in an internal combustion engine. A rotational rod is coupled to a gear lever and the mechanism for putting the throttle back, which is protected by a cover. A throttle sensor is coupled to the rotational rod, which is also covered by a cover. Since the mechanism for putting the throttle back is covered, it is easy to prevent the deterioration of the mechanical parts, the entry of the foreign matter, corrosion, and to improve reliability. Also, because the throttle sensor is installed to the end of the apparatus for controlling the throttle valve, it is easy to adjust/readjust or install/exchange the throttle sensor, improve miniaturization, reduce weight, and lower cost.

5 Claims, 4 Drawing Sheets

APPARATUS FOR CONTROLLING A THROTTLE VALVE ELECTRONICALLY IN AN INTERNAL COMBUSTION ENGINE

BACKGROUND OF THE INVENTION

1. Field of the Invention

The present invention relates to improvements to an apparatus for controlling a throttle valve electronically by an actuator such as an electronic motor in an internal combustion engine.

2. Description of the Background Art

Recently, control for a throttle valve of an internal combustion engine having multiple functions has been realized. The multiple functions are 1) interlocking with an accelerator pedal depressed by an operator; 2) traction control so as to reduce an opening angle of the throttle valve to reduce slips of vehicular tire wheels during a vehicular acceleration; and 3) automatic cruise control to maintain a constant vehicular speed with the accelerator pedal open or not depressed. Additionally, a fail safe structure is provided such that an overrun of engine revolutions is suppressed with the opening angle of the throttle valve held at a minimum position during a failure of the engine.

Japanese Patent Application First Publication No. Showa 62-284932 published on Dec. 10, 1987 exemplifies a previously proposed throttle valve opening angle controlling apparatus in which traction control is carried out.

In the disclosed Japanese Patent Application, a restricting plate is located between the throttle valve shaft bearing on the motor side and a gear mechanism that transmits the rotation of the motor to the throttle valve shaft.

However, in the previously proposed throttle valve opening angle controlling apparatus, since the motor is not covered by a casing, deterioration of the mechanical parts is induced by the entry of the foreign matter, and corrosion, thereby reducing the reliability.

The design must also be coaxial with the motor and the throttle valve, and the length of the apparatus increases in length, which may cause the reduction of the anti-vibration.

SUMMARY OF THE INVENTION

It is, therefore, an object of the present invention to provide an apparatus for controlling a throttle valve electronically in an internal combustion engine which improves the reliability and miniaturization, thereby reducing the cost and the weight.

In view of the above, an apparatus for controlling a throttle valve electronically according to the present invention comprises a throttle valve with a central rotation axis installed in an intake air passage of an internal combustion engine, and a rotational rod positioned on the central rotation axis of the throttle valve, and an actuator to rotate the rotational rod, and a returning member to change a throttle open angle of the throttle valve to a predetermined open angle or a maintaining member to maintain the throttle open angle on the predetermined open angle in a case, and a throttle sensor to detect the throttle open angle in order to control the actuator.

With such a structure for the present invention, the throttle sensor is installed in the opposite side of the actuator, the mechanism for putting the throttle back, and it is easy to adjust/readjust or install/exchange the throttle sensor.

In addition, the returning member or maintaining member is installed in the case, and this design prevents the deterioration of the mechanical parts, the entry of foreign matter, and corrosion, and improves reliability in the above apparatus for controlling the throttle valve electronically in the internal combustion engine. This design also simplifies the application of a rust inhibitor treatment to the mechanism for putting the throttle back, thereby reducing the cost.

The present invention further comprises a lip-shaped sealant to be installed between the intake air passage and the returning member, which is capable of providing the hermeticity of the whole apparatus, and also preventing air leakage from the cylinder bore to the part covered with the cover and the case (the mechanism for putting the throttle back or the actuator), or the part covered with the cover and the case.

As a result, the present design is capable of improving anti-corrosion and functional deterioration of the mechanism for putting the throttle back, the actuator, and the throttle sensor.

DETAILED DESCRIPTION OF THE PREFERRED EMBODIMENTS

Figure 3:
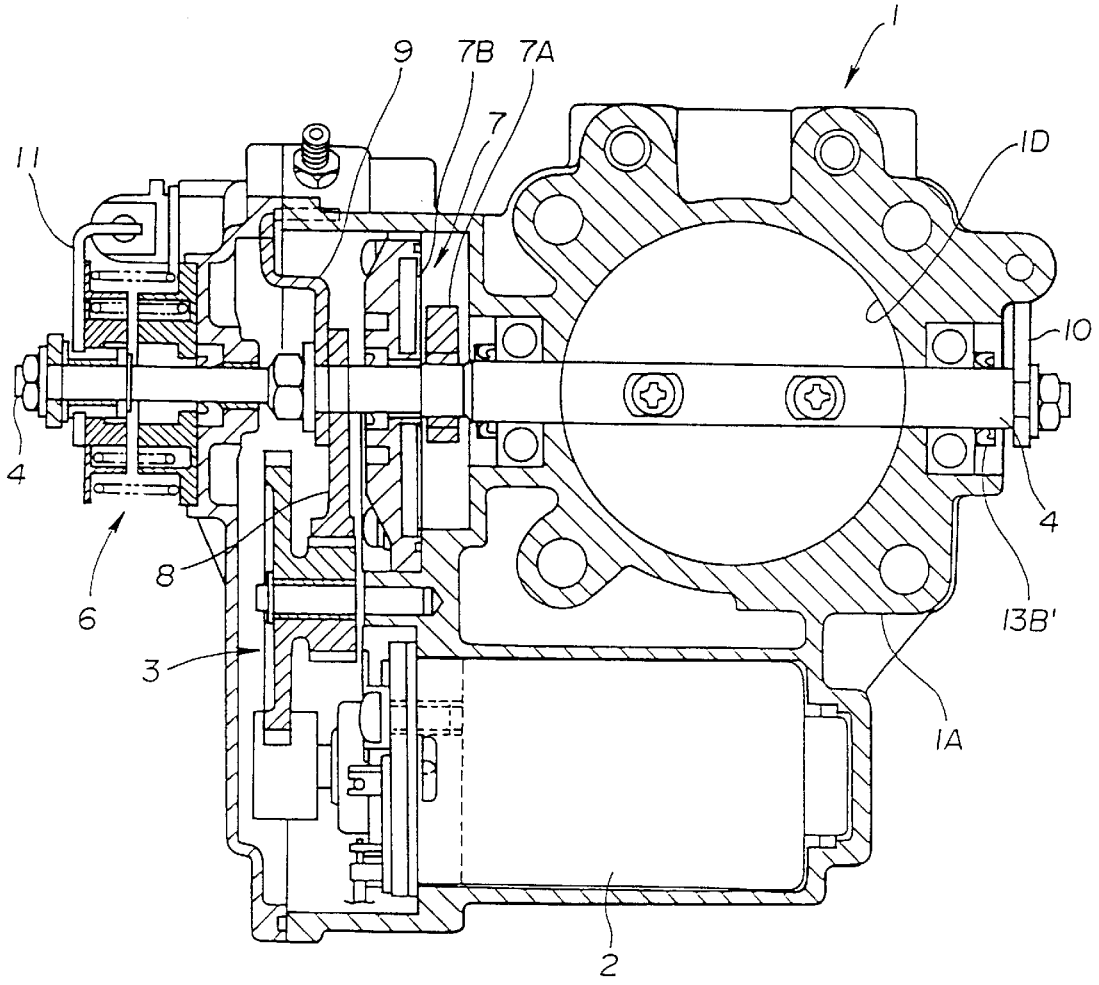
FIG. 3 is a section view of an apparatus for controlling a throttle valve electronically according to the previous proposed design.
Figure 4:
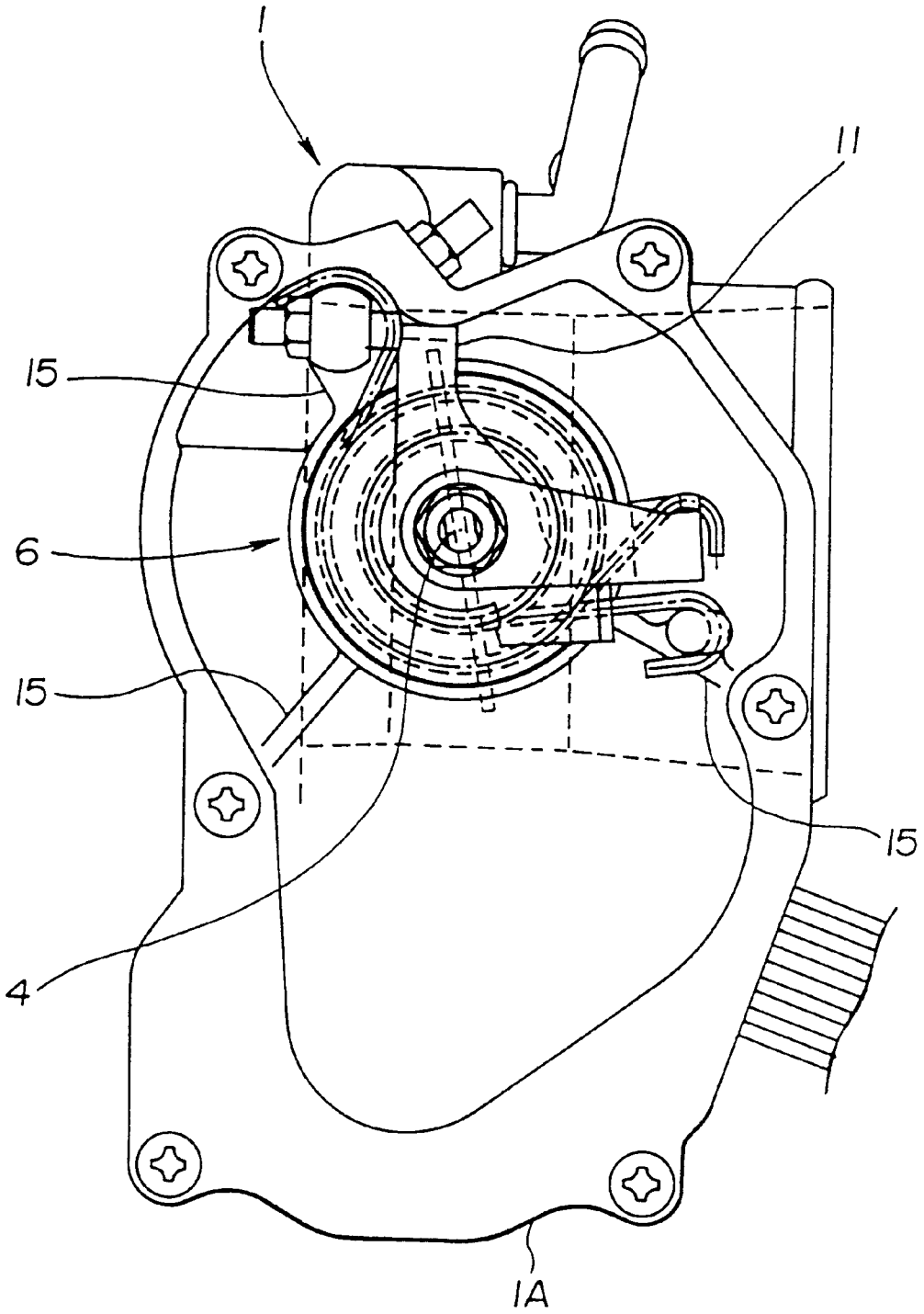
FIG. 4 is a side view of an apparatus for controlling a throttle valve electronically according to the previous proposed design.

One internal proposal for a design that is not prior art is shown in FIGS. 3,4. It is installed in an intake air passage of an internal combustion engine, and an actuator 2 such as electronic motor generates driving power on the basis of a driving signal of a control unit, which can open/close the throttle valve through the gear wheel transfer structure 3 and the axis 4, and the actuator can make an adjustment to the open angle of a throttle valve which is separated from the accelerator operation of the driver.

However, the above previously proposed designs 1 for controlling the throttle valve electronically has an unprotected mechanism 6 for putting the throttle back which generates the power for putting the throttle valve 5 back in the direction of the throttle closed, (i.e. the engine can start even if the throttle valve 5 is not opened by the actuator, or the open angle of the throttle valve is maintained at a predetermined position when the driving power of the actuator is opened so that it is possible to drive even if the actuator is broken). As a result, it is easier to induce the deterioration of each mechanical part, the entry of the foreign matter, corrosion, and to reduce the reliability.

It is also necessary to mount the throttle sensor 7 for detecting the open angle of the throttle valve 5, and the gear lever 8 for driving the axis 4, and the stopper 9 for ensuring the minimum open angle on the axis 4 between the mechanism 6 for putting the throttle back and the throttle valve 5, and the length of the apparatus 1 increases in length, which may cause the reduction of the anti-vibration.

Furthermore, the throttle sensor 7 is installed in the case 1A on the axis 4 of the throttle valve 5, which is sandwiched between the throttle valve 5 and the gear lever 8, the stopper 9 for ensuring the minimum open angle which is installed on the axis 4 of the opposite side of the throttle valve 5, and it is difficult to do the adjustment or the installation of the throttle sensor 7. Since the gear lever 8 or the stopper 9 for ensuring the minimum open angle is installed after the throttle sensor 7 has been installed, the throttle valve 5 rotates freely when the throttle sensor 7 is adjusted or installed, which may not be capable of being in a good position or the edge of the throttle valve 5 comes into collision or meshes with the cylinder bore 1D (comprising part of the intake passage). It is also difficult to adjust or install when the throttle sensor 7 is installed in the back of the case 1A, and for this reason, it must be necessary to use a special instrument for adjusting or installing, and an assist lever 10 for preventing the collision with the bore, which causes high cost, increasing the number of the installation, reducing the reliability, and taking much time for readjusting or exchanging of the throttle sensor 7.

Figure 1:
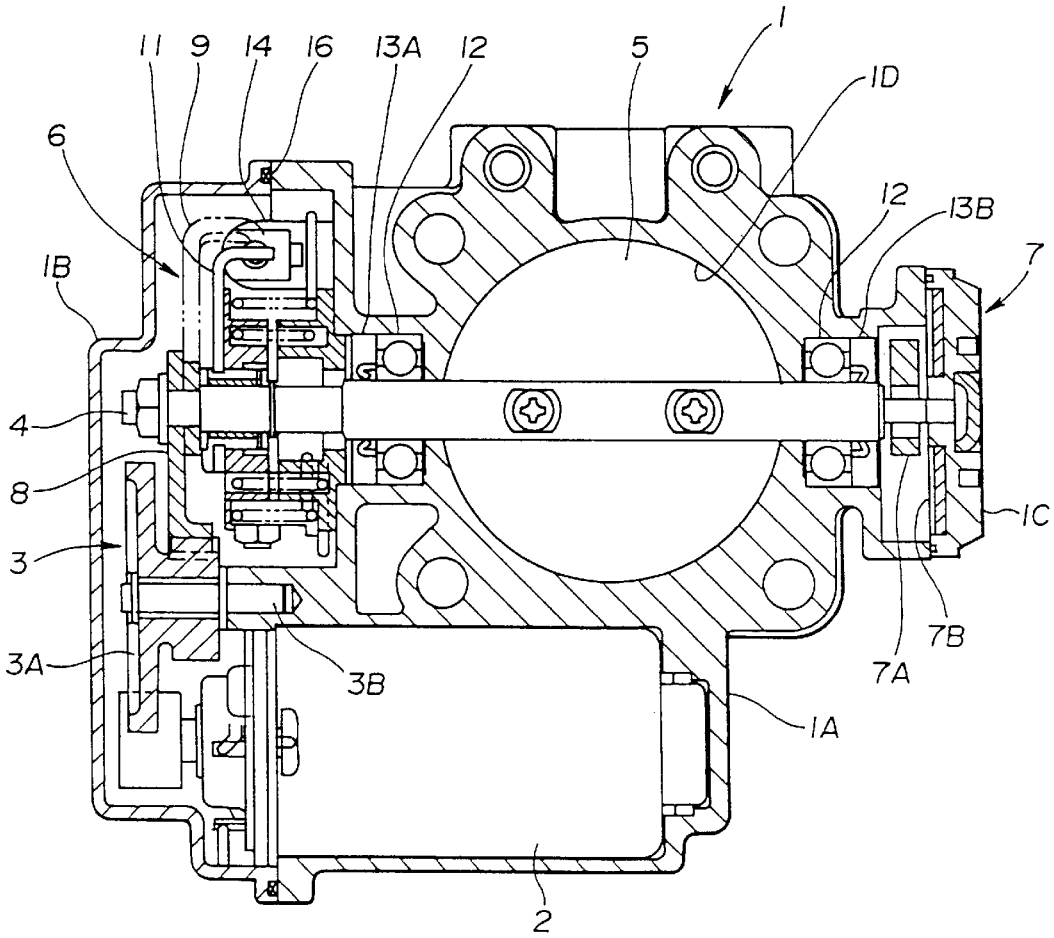
FIG. 1 is a section view of an apparatus for controlling a throttle valve electronically according to the present invention.
Figure 2:
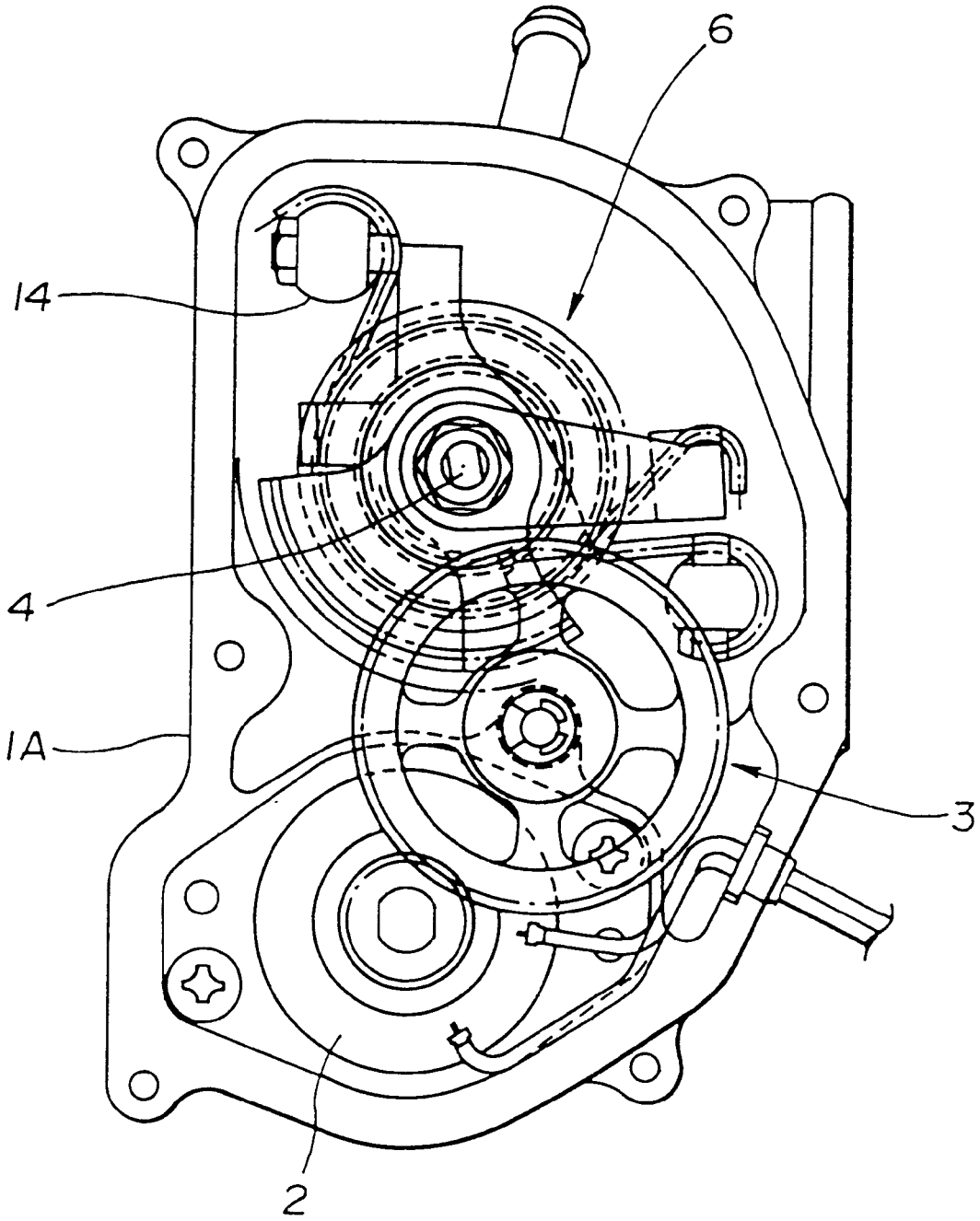
FIG. 2 is a side view of uncovering the case 1C of the apparatus of the present invention.

A more detailed description of the present invention is given below on the basis of attached figures which are provided with the same numbers for same elements as shown FIGS. 3,4. The embodiment associated with the present invention is shown in FIGS. 1,2, which indicates a throttle valve 5 installed in an intake air passage of an internal combustion engine. A cylinder bore 1D (which comprises part of the intake air passage area) can be adjusted by the throttle valve 5 which opens/closes around a rotation rod 4 disposed on a central rotation axis for the throttle valve.

An actuator 2 such as an electronic motor generates driving power on the basis of a driving signal of a control unit (not shown). This driving power is transferred via a gear wheel transfer structure 3, a gear lever 8, the rotation rod 4, etc. to the throttle valve 5, to thereby make an adjustment to an open angle of the throttle valve 5.

Note that this is separated from the accelerator operation of the driver. The present embodiment shows that the gear lever 8 (the maintaining member) is installed on the left end of the rotation rod 4, which is covered by a cover 1B, and the full-throttle stopper 11 and the mechanism 6 for putting the throttle back are also installed on the right side of the gear lever 8.

Furthermore, the above mentioned mechanism 6 for putting the throttle back encompasses the mechanism 6 for putting back or maintaining the throttle open angle of the present invention.

The rotation rod 4 is supported by a set of bearings 12, which is installed to the right of the mechanism 6, on either side of the throttle valve 5. Moreover, a set of lip seals 13A,13B is installed on the outside of each bearing 12.A throttle sensor 7 in connection with the present invention is coupled to the rotation rod 4, and is covered by the cover 1C in the right end of the throttle valve apparatus 1. The throttle sensor 7 comprises a brush 7A which rotates with the rotation rod 4 and the throttle valve 5, and a circuit board 7B which is fixed on the case 1A. The open angle of the throttle valve 5 can be detected by the relative rotation angle between the rotation rod 4 or throttle valve 5 and the case 1A. Since the mechanism 6 for putting the throttle back is covered by cover 1B, this design prevents the deterioration of the mechanical parts, the entry of foreign matter,and corrosion, and improves reliability in the above apparatus for controlling the throttle valve electronically in the internal combustion engine. This design also simplifies the application of a rust inhibitor treatment to the mechanism 6 for putting the throttle back, thereby reducing the cost.

Since the gear lever 8, the stopper 9 for the minimum open angle and the full-throttle stopper 11 are adjacent to each other, stopper portion 14 is shared between the stopper 9 for the minimum open angle 1.

The present design allows shortening of the length of the rod 4 and miniaturizing of the throttle valve apparatus by designing the bend of the gear lever 8 and the stopper 9 for the minimum open angle, improving the anti-vibration and the weight reduction and the cost.

Furthermore, with the throttle sensor 7 in the present embodiment not installed between the throttle valve 5 and the mechanism 6 for putting the throttle back, the design shortens the length from the bearing 12 of the rotational rod 4 to the mechanism 6 for putting the throttle back and minimizes the moment exerted on the supporting member of the mechanism 6 for putting the throttle back. Note that the stiffening rib 15 on the supporting member of the mechanism 6 is not necessary in the present design. Accordingly, the present design has reduced cost, reduced the weight, and improved operational response and reliability. Additionally, the friction or the wear on the bearing 12 is reduced.

Furthermore, after the gear lever 8,the stopper 9 for the minimum open angle, and the full-throttle stopper 11 are first installed, a collision between the throttle valve 5 and the cylinder bore 1D can not occur the throttle valve 5 comes into contact with the stopper 11, which is capable of maintaining a predetermined position. The throttle sensor 7 is installed on one end of the throttle valve apparatus 1 (the right end as shown FIG. 1.

As a consequence, it is not necessary to prepare a special tool or an assist lever 10 (as shown FIG. 3) for installation at the predetermined position. This feature improves productivity, cost, reduces weight and facilitates miniaturization.

In addition, in the previous proposed design of FIG. 3, when the throttle sensor 7 is installed within the actuator 2 side of the case 1A, it is necessary to keep a predetermined distance between the pin 3B which fixes the rotational center of the intermediate gear 3A of the gear wheel transfer structure 3 and the largest outside diameter of the circuit board portion 7B. A considerable distance must be kept between the rotational center of the actuator 2 and the rotational center of the rotational axis 4.

In the present embodiment, since the throttle sensor 7 is installed in the end of the throttle valve apparatus 1, only a short distance is provided between the rotational center of the actuator 2 and the rotational center of the rotational axis 4, and it is capable of improving the miniaturization, the weight reduction, and the low cost.

Since the throttle sensor 7 is installed in the end of the throttle valve apparatus 1, the throttle sensor 7 is not installed deep within the actuator 2 side of the case 1A as the previous proposed apparatus, and other parts (the gear lever 8, the stopper 9 for the minimum open angle and the full-throttle stopper 11) are not positioned between the throttle sensor 7 and a worker. Therefore, it is easy to adjust/readjust or install/exchange the throttle sensor 7.

Furthermore, the external design of the throttle valve apparatus is improved by covering the mechanism 6 for putting the throttle back.

In the present embodiment, a gum sealant 16 (or an o-ring or the liquefied sealant) is positioned at the mating faces between the cover 1B and the case 1A, and a gum sealant 17 (or an o-ring or the liquefied sealant) is also positioned at the mating faces between the cover 1C and the case 1A.

When a positive pressure occurs in the cylinder bore 1D, since both the lip-shaped sealant 13A, 13B are positioned toward the direction of increasing pressure of the sealing surface, it can prevent leakage of air from the cylinder bore 1D to the side of the cover 1B or 1C.

When a negative pressure occurs in the cylinder bore 1D, since the pressure of the sealing surface on the lip-shaped sealant 13A, 13B is reduced, the hermeticity of the case 1A is provided by the gum sealant 16, 17.

Therefore, in the present embodiment, regardless of the condition of the pressure in the cylinder bore 1D, the hermeticity of the case 1A can be provided with reliability, and when a positive pressure occurs, the design is capable of preventing a reduction of pressure at the sealing face and an air leak to the outside.

Note that it is not essential in the present invention to have the lip-shaped sealant 13A,13B in the direction shown in FIG. 1. But if the lip-shaped sealant 13A,13B is positioned in the above mentioned direction, it is capable of providing the hermeticity of the whole apparatus, and also preventing the air leakage from the cylinder bore 1D to the part covered with the cover 1B and the case 1A (the mechanism 6 for putting the throttle back or the actuator 2), or the part covered with the cover 1C and the case 1A. As a result, the present design is capable of improving anti-corrosion and anti-functional deterioration of the mechanism 6 for putting the throttle back, the actuator 2, and the throttle sensor 7.

What is claimed is:

1. An apparatus for controlling a throttle valve electronically in an internal combustion engine, comprising:

a) a throttle valve with a central rotation axis installed in an intake air passage of an internal combustion engine;

b) a rotational rod positioned on the central rotation axis of said throttle valve;

c) an actuator to rotate said rotational rod;

d) a returning member to change a throttle open angle of the throttle valve to a predetermined open angle;

e) a casing covering said returning member; and f) a throttle sensor to detect said throttle open angle in order to control said actuator;

wherein said actuator is engaged to said returning member on one-end of said rotational rod, and the actuator is disposed in parallel with said rotational rod and extends back part way along the length of said rotational rod from where it is engaged to said returning member, and wherein said throttle sensor is located on an other end of said rotational rod to thereby minimize contact failure and to provide easy installation and maintenance of said throttle sensor.

2. An apparatus for controlling a throttle valve electronically in an internal combustion engine as set forth in claim 1, which further comprises a lip-shaped sealant disposed around said rotational rod between said intake air passage and said returning member.

3. An apparatus as defined in claim 1, further comprising:

a maintaining member to maintain the throttle open angle at a predetermined open angle, wherein said actuator is engaged to said maintaining member on said one-end of said rotational rod, and the actuator is disposed in parallel with said rotational rod and extends back part way along the length of said rotational rod from where it is engaged to said maintaining member.

4. An apparatus for controlling a throttle valve electronically in an internal combustion engine, comprising:

a) open/close means with a central rotation axis for installation in an intake air passage of an internal combustion engine;

b) rotational means positioned on the central rotation axis of said open/close means;

c) actuator means for rotating said rotational means;

d) returning means for putting the throttle open angle back to a predetermined open angle;

e) a casing covering said returning means; and f) detecting means for detecting said throttle open angle in order to control the actuator wherein said actuator means is engaged to said returning means on one-end of said rotational means, and the actuator means is disposed in parallel with said rotational means and extends back part way along the length of said rotational means from where it is engaged to said returning means; and wherein said detecting means is located on an other end of said rotational means to thereby minimize contact failure and to provide easy installation and maintenance of said throttle sensor.

5. An apparatus for controlling a throttle valve electronically in an internal combustion engine as set forth in claim 4, which further comprises a lip-shaped sealant disposed around said rotational rod between said intake air passage and said returning means.

* * * * *